US010184756B1

(12) United States Patent
McCauley et al.

(10) Patent No.: US 10,184,756 B1
(45) Date of Patent: Jan. 22, 2019

(54) RAIL MOUNTED WEAPON LIGHT

(71) Applicants: Sean McCauley, Newburgh, IN (US); Eric Small, Alabaster, AL (US); David A. Winge, Boonville, IN (US); Matt Tenbarge, Newburgh, IN (US)

(72) Inventors: Sean McCauley, Newburgh, IN (US); Eric Small, Alabaster, AL (US); David A. Winge, Boonville, IN (US); Matt Tenbarge, Newburgh, IN (US)

( * ) Notice: Subject to any disclaimer, the term of this patent is extended or adjusted under 35 U.S.C. 154(b) by 0 days.

(21) Appl. No.: 15/875,809

(22) Filed: Jan. 19, 2018

Related U.S. Application Data

(60) Provisional application No. 62/506,023, filed on May 15, 2017.

(51) Int. Cl.

| | |
|---|---|
| ***F41G 1/34*** | (2006.01) |
| ***F41G 1/35*** | (2006.01) |
| ***F21V 21/34*** | (2006.01) |
| ***F21V 23/04*** | (2006.01) |
| ***F21L 4/00*** | (2006.01) |

(52) U.S. Cl.
CPC ..... *F41G 1/35* (2013.01); *F21L 4/00* (2013.01); *F21V 21/34* (2013.01); *F21V 23/0414* (2013.01)

(58) Field of Classification Search
CPC ..... F41G 1/32–1/36
USPC ..... 362/110
See application file for complete search history.

(56) References Cited

U.S. PATENT DOCUMENTS

2012/0020063 A1* 1/2012 Mironichev ..... F21L 4/025 362/191

* cited by examiner

*Primary Examiner* — Sean Gramling

(57) ABSTRACT

A rail mounted weapon light for being interfaced with firearm platforms. The weapon light defines an outer housing that includes a main body and an integral outer housing extension that defines an interface profile shaped and sized to slidably engage the track of the firearm platform. The outer housing is configured such that there is an offset between the outer housing extension and the main body. A pressure switch is disposed on the outer housing extension. The pressure switch having a momentary on function and a constant on function. The main body including a head portion that defines an inner chamber for receiving the electronics of the weapon light. The electronics of the weapon light being in electronic communication with the pressure switch.

19 Claims, 5 Drawing Sheets

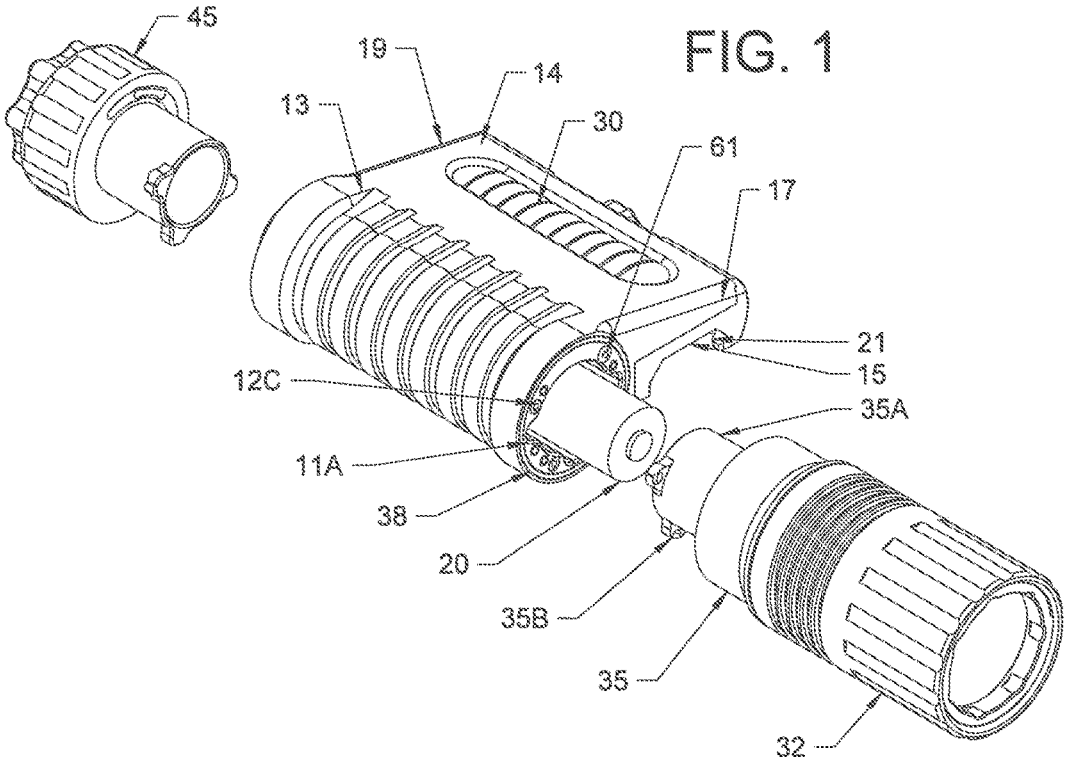
FIG. 1
FIG. 2
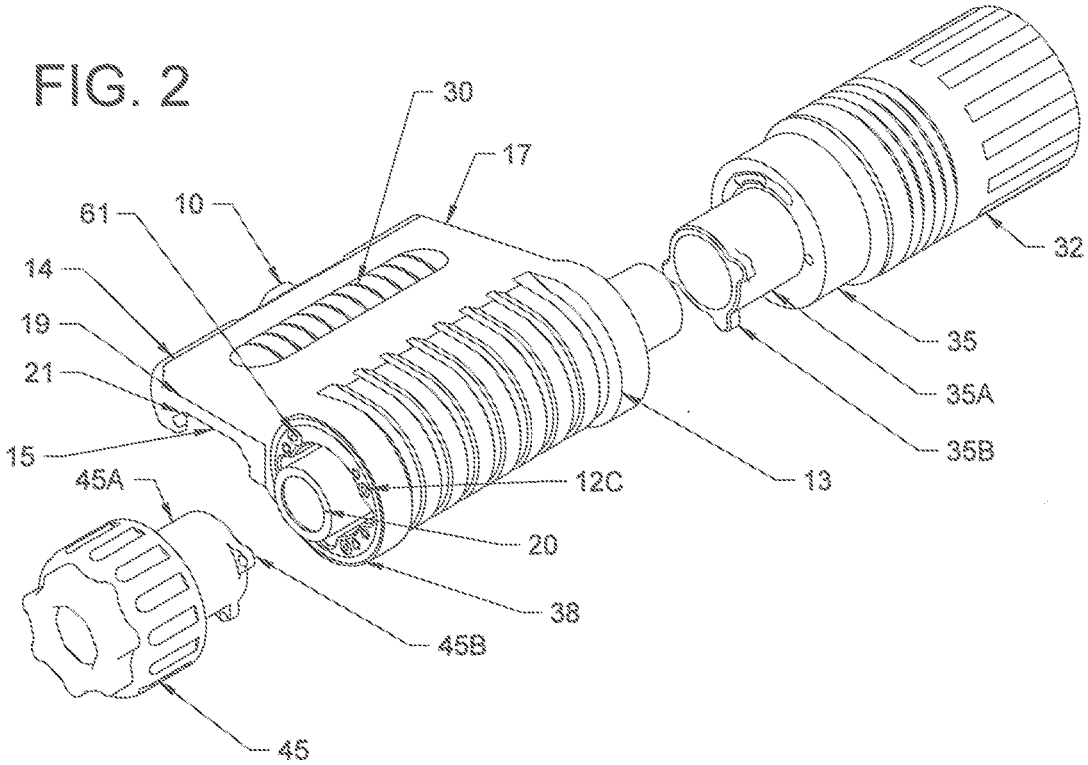

RAIL MOUNTED WEAPON LIGHT

CROSS REFERENCES TO RELATED APPLICATIONS

U.S. Provisional Application for Patent No. 62/506,023, filed May 15, 2017, with title "Rail Mounted Weapon Light" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates generally to a weapon light that is particularly suited for being interfaced with all long firearms having a MIL-STD 1913 accessory mounting rail. More specifically, the present invention relates to a modular one-piece weapon light that is configured for mounting on a firearm's interface rail and is adaptable for mounting on either the right hand or the left hand side of the firearm's platform.

2. Brief Description of Prior Art

In the prior art, weapon lights or flashlights for use in firearm applications have typically been constructed in a standard fashion utilizing multiple components including a weapon light, a weapon light mount, a socketed tail-cap, a tape switch and a tape switch mount. As is known, all these components are separate in constructing the prior art weapon light. As such, in order to move and mount the prior art weapon light from the left side of the firearm's platform to the right side for example, the user is often required to first disassemble the multiple and separate parts of the flashlight and then reassemble. Such process can be both time consuming and precise.

In view of the foregoing disadvantages inherent in the prior art flashlights, there is a need for a weapon light device that provides an improved method of reliably mounting the weapon light device onto a firearm's platform with the advantage of being both modular and reversible meaning the user is able to quickly move and mount the one-piece weapon light from the left side of the firearm's platform for example, to the right side quickly, without having to coordinate multiple components. It is with this need in mind that the present invention was developed.

SUMMARY OF THE INVENTION

A rail mounted weapon light that is particularly suited for being interfaced with all long firearms having a MIL-STD 1913 accessory mounting rail. The weapon light defines an outer housing that is configured for interfacing the weapon light with the firearm platform.

The outer housing includes a main body and an integral outer housing extension that defines an interface profile shaped and sized to slidably engage the track of the firearm platform. An end cap that attaches to one end of the main body for connection to the negative side of the batteries. A light end cap attaches to the other end of the main body. The light end cap has provisions where a flash light head is attached. Importantly, the outer housing is configured such that there is an offset between the outer housing extension and the main body. The outer body contains a section designed to be fitted and tightened against the mounting rail with threaded fasteners.

The outer housing includes a pressure switch generally opposite the main body profile on the outer housing extension over the rail attachment section and parallel to the main body. The pressure switch having a momentary on function and a constant on function.

The main body of the weapon light defining a head portion that defines an inner chamber for receiving the electronics of the weapon light and batteries. The electronics of the weapon light being in electronic communication with the pressure switch.

BRIEF DESCRIPTION OF THE DRAWINGS

FIGS. 1 and 2 are exploded views of a preferred embodiment of the present invention, a rail mounted weapon light.

DESCRIPTION OF THE PREFERRED EMBODIMENT

Figure 3:
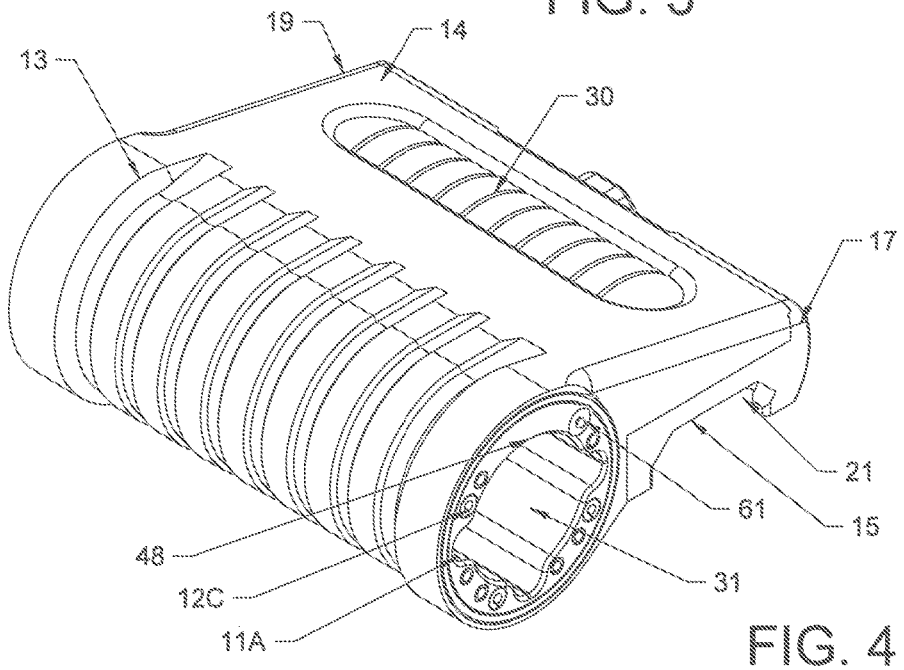
FIG. 3 illustrates the main body of the present invention.
Figure 4:
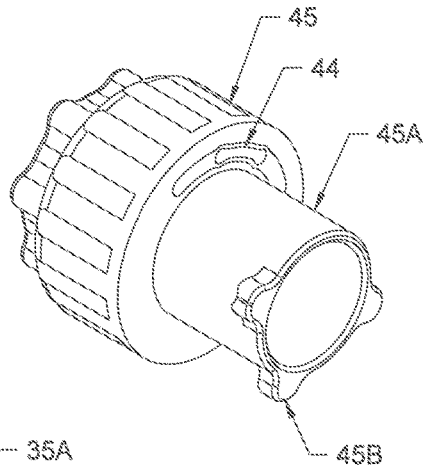
FIG. 4 illustrates the negative end cap of the present invention.
Figure 5:
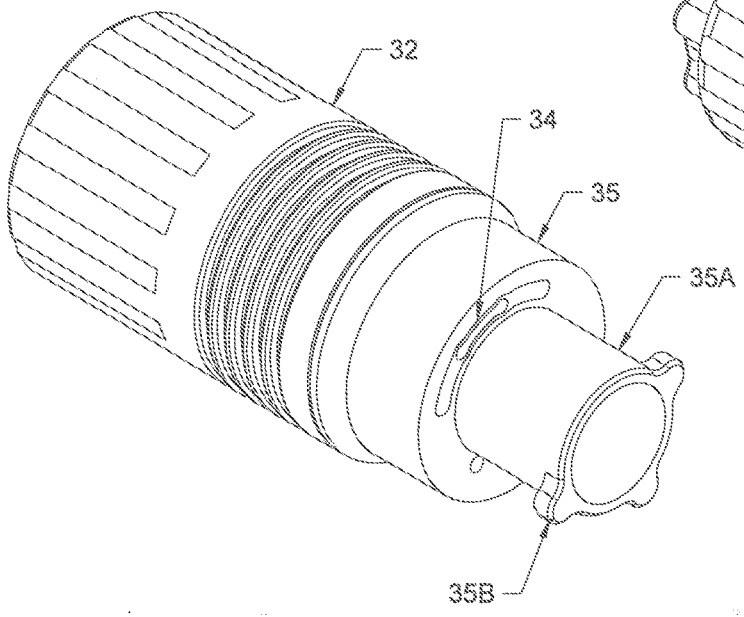
FIG. 5 illustrates the body light head assembly of the present invention.
Figure 6:
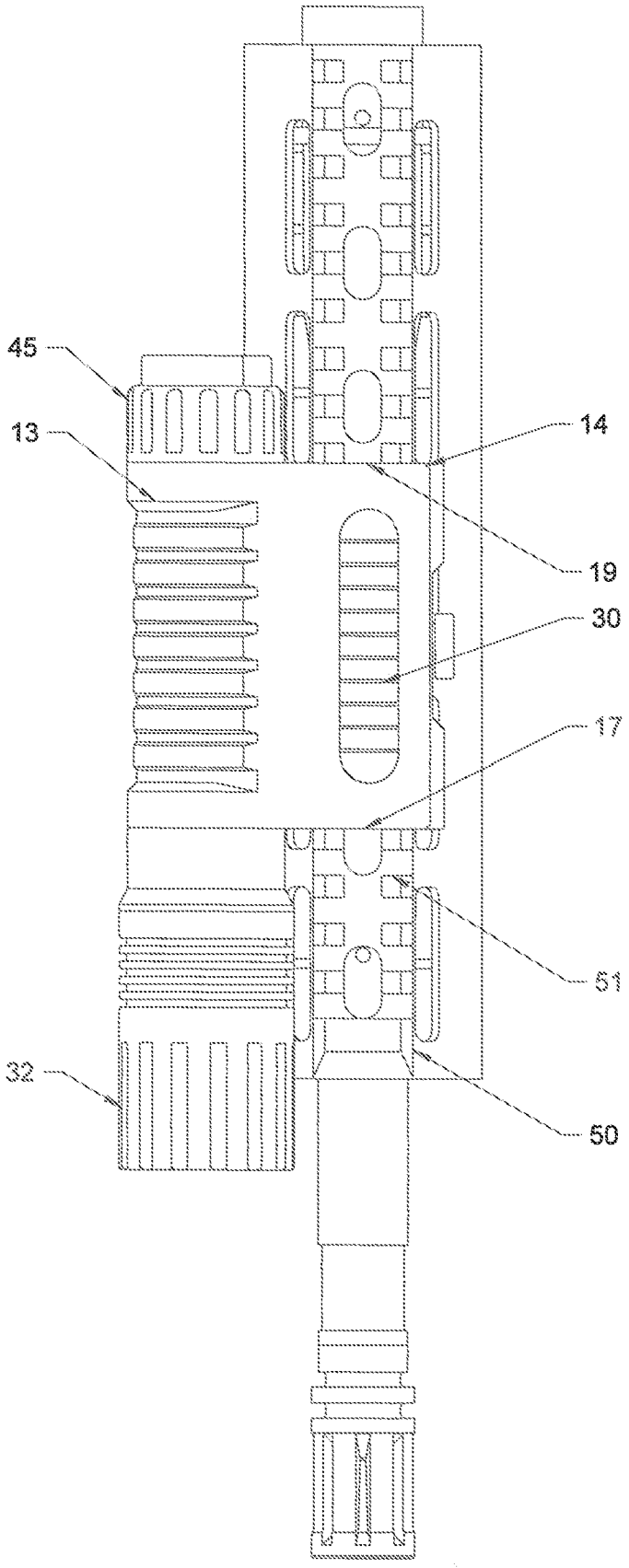
FIG. 6 is a top view of the present invention mounted to an interface rail of a firearm.
Figure 7:
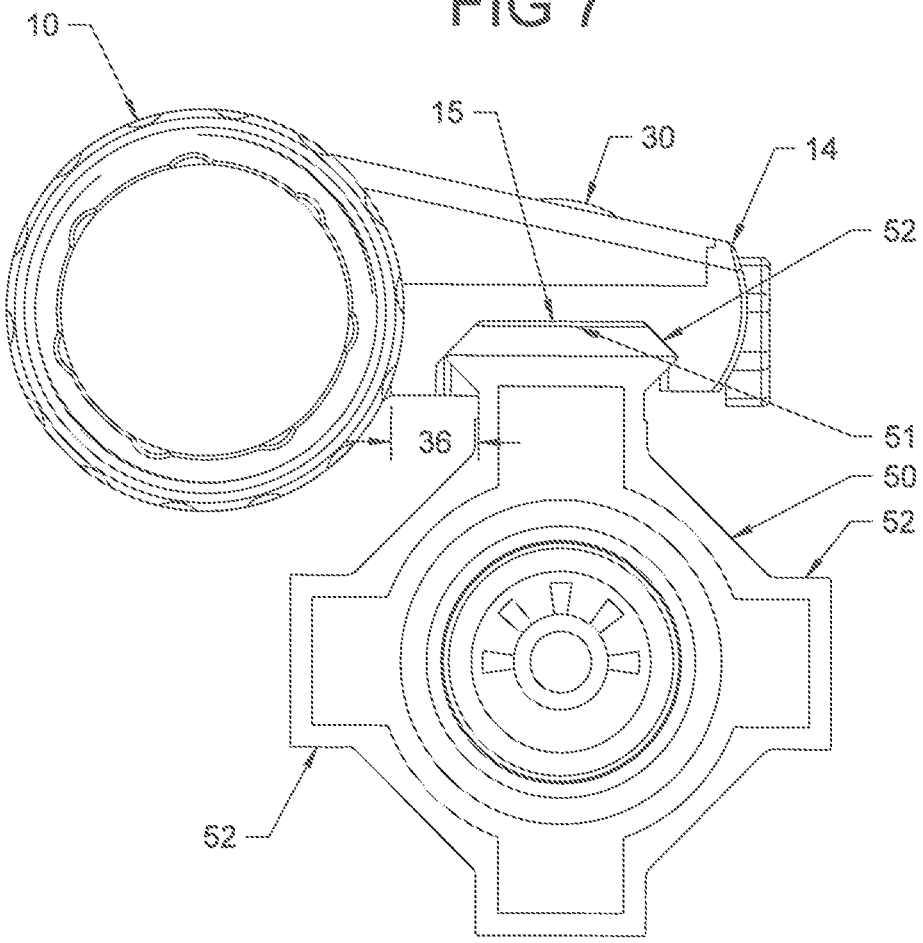
FIG. 7 is a front view of the present invention mounted to the interface rail.
Figure 8:
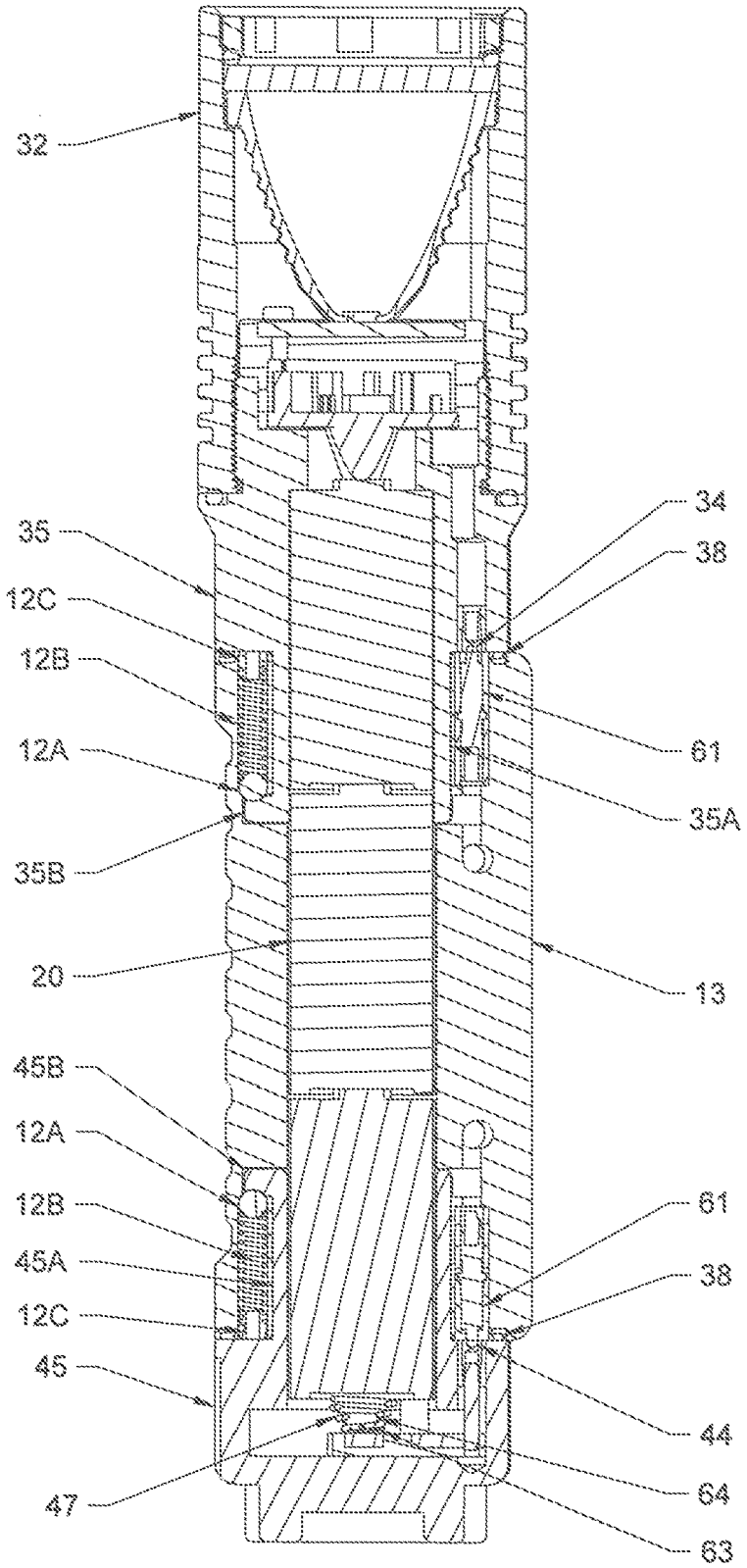
FIG. 8 is a top sectional view of the present invention.

The present invention is directed to a rail mounted weapon light that is particularly suited for being interfaced with all long firearms having a MIL-STD 1913 accessory mounting rail. The present invention discloses a one-piece weapon light that is both modular and reversible and can be easily and quickly selectively moved and mounted on the firearm's platform. In the broadest context, the weapon light of the present invention consists of components configured and correlated with respect to each other so as to attain the desired objective.

As illustrated, the weapon light 10 defines the main body 13 that is configured to interface the weapon light 10 with all long firearms having a MIL-STD 1913 accessory.

Generally, modern type firearms include a platform or interface rail 50 integrated thereon for the mounting of auxiliary devices. The interface rail 50 takes the form of various rail systems that often extend along and around the barrel of the firearm to provide interface rails both along the top of the firearm as well as at the 3, 6 and 9 o'clock positions around the barrel. Generally, the interface rail 50 provides a standardized profile that includes at least one track 51 and at least one side 52, and are configured specifically for the mounting of various accessories depending on the type environment in which the firearm will be used.

An integral outer housing extension 14 of the main body 13 defines a rail interface profile 15 formed therein and shaped and sized such that the weapon light 10 is particularly suited to interface with the track 51 of the accessory rail 50 of the firearm. More particularly, the outer housing extension 14 of the weapon light 10 is machined or molded having a first end 17 and a second end 19 and a channel 21 that defines the interface profile 15 that extends from the first end 17 to the second end 19.

The channel interface 21 defining the interface profile 15 is configured to engage the track 51 of the rail mounting interface 50 of the firearm. In this manner, the weapon light 10 of the present invention can be slidably received onto the track 51 of the rail interface 50 and more particularly, can be easily and quickly selectively moved and mounted onto any of the supplemental rails commonly located at the 3, 6 and 9 o'clock positions relative to the firearm barrel.

The pressure switch 30 is generally opposite the interface profile 15 on the outer housing extension 14, and like the interface profile 15 extends from approximately the first end 17 to approximately the second end 19 of the outer housing extension 14.

The pressure switch 30 having a momentary on function and a constant on function.

As shown in the drawings, the main body 13 of the weapon light 10 further defines a first end of the body 13 that has the light head assembly 32 connected thereto, and a second, opposite end of the body 13 that shows the negative end cap 45 attached thereto. As will be understood, both the described first end of the body 13 and second, opposite end are in electrical communications with the pressure switch 30.

As further illustrated, the main body 13 is configured such that there is an offset and defined spacing 36 between the body 13 and the rail 50. In particular, as described, the extension 14 is positioned on the track 51 and the main body 13 is then positioned or offset adjacent a side 52 of the rail 50 so that the main body 13 is disposed out of the user's field of view.

The preferred power supply 20 of the present invention is either at least one CR123 battery (preferably two (2) CR123 batteries) or a rechargeable lithium battery. However, the present invention can accommodate other power sources including but not limited to, a three (3) battery cell configuration. The power supply in electrical communications with the electronics and the pressure switch.

1. Main body is preferably made from aluminum and contains mount provisions for the integrated pressure switch 30, a hollow section 31 for housing the power supply 20, a first recess 48 at the light mount end of the body 13, and a second recess 49, identical to the first recess 48, at the negative cap end of the body 13.

The main body 13 includes an end cap O-ring 38 that is positioned with the first recess 48 for a water tight seal. This portion of the body 13 is configured to conduct the negative side of the battery 20 to the light head assembly 32. An end cap O-ring 38 is similarly positioned with the second recess 49 for a water tight seal.

2. Light mount end cap 35 is preferably made from aluminum and defines a shaft 35A having at least one lug member 35B disposed adjacent the end of the shaft 35A. The at least one lug member 35B configured to engage a detent 11A disposed in the first recess 48 to releasably lock the end cap 35 in position with the body 13.

The detent 11A is preferably structured to receive a hardened ball 12A, an elastic member 12B, such as a compression spring, and a fastener 12C, preferably a press-in pin, or a set screw, where the elastic member 12B engages the ball 12A on one end thereof and the fastener 12C on the opposing end thereof, and the fastener 12C is preferably installed adjacent or within the first recess 48. The ball 12A and the elastic member 12B are held in place by means of the fastener 12C.

The hardened ball 12A or another engager can comprise a hemispherical portion structured for engagement via a ball and detent methodology. However, other shaped portions are possible, whether additionally or alternatively, such as a polyhedron, whether spherical or non-spherical. The ball 12A and elastic member 12B can also be combined into an entity, such as a flat spring.

The ball and detent configuration as described is configured such that the ball 12A will releasably engage the at least one lug member 35B to lock the light head assembly into place with the body 13. Rotation of the end cap 35 quickly connects and disconnects the light head assembly 32 to and from the body 13.

Light mount end cap 35 may extend forward to the edge of the light head bezel to house infrared light, infrared laser and visible laser modules that are aligned for the purpose of using only one elevation and windage control dial for both lasers, respectively.

3. Negative end cap 45 is preferably made from aluminum, and defines a shaft 45A having at least one lug member 45B disposed adjacent the end of the shaft 45A.

The at least one lug member 45B configured to engage a detent 11B disposed in the second recess 49 to releasably lock the cap end 45 in position with the body 13.

The detent 11B is preferably structured to receive a hardened ball 12A, an elastic member 12B, such as a compression spring, and a fastener 12C, preferably a press-in pin, or a set screw, where the elastic member 12B engages the ball 12A on one end thereof and the fastener 12C on the opposing end thereof, and the fastener 12C is preferably installed adjacent or within the second recess 49. The ball 12A and the elastic member 12B are held in place by means of the fastener 12C.

The ball and detent configuration as described is configured such that the ball 12A will releasably engage the at least one lug member 45B to lock the negative end cap 45 in place with the body 13. Rotation of the end cap 45 quickly connects and disconnects the negative end cap 45 to and from the body 13.

4. Pressure switch 30 is positioned parallel to the main body 13, over the top of the mounting rail 50, and is connected via electrical wire (not shown) to spring loaded contact pins 61 on each end of the main body 13. Pressure switch 30 may be extended to include a three-button system (IR flood/IR laser control, visible laser/white light control, power setting). Preferably, power setting button will be in the rear (behind the other two buttons), and it will be slightly smaller in size. Adjacent to the main three-button control will be two (2) small on/off buttons, equal in size, labeled and adjacent to each other. Functionally, one will disable visible laser, and one will disable IR laser.

5. Batteries 20 provide electrical power source to power the light head assembly 32.

6. Battery spring 47 is configured to make conductive contact with the negative end of the battery 20 and contact plate 44 situate on negative end cap 45, or contact plate 34 situate on end cap 35. Contact plate 34 and 44 make an electrical connection with contact pin 61 on the main body 13.

7. Flat washer 63 is used to retain the battery spring 47 to the negative end cap 45.
8. Machine screw 64 is used to retain the battery spring 47 to the negative end cap 45.
9. End cap O-rings 38 provide water tight seal between the negative end cap 45. the light mount end cap 35, and the main body 13.
10. Light head assembly 32 provides illumination and may contain one or two reflectors to provide light in two (2) different spectrums (visible and IR).

Preferably, IR flood/IR laser controls will be digital. Momentary activation with press/hold for eight (8) seconds going to constant on. Double click in less than 0.4 seconds for constant on. Single click to turn off constant on feature. Further, visible light/visible laser controls will be digital. Momentary activation with press/hold for eight (8) seconds going to constant on. Double click in less than 0.4 seconds for constant on. Single click to turn off constant on feature. The power setting control 30 controls output to the IR laser and IR flood. Double tap in less than 0.4 seconds to control power output to the entire system. Low power, medium power, high power. Single tap does nothing. Press/hold does nothing.

As described, both the negative end cap 45 and the light end cap 35 can be quickly removed from the main body 13. When detached, the end cap O-ring 38 remains attached to the main body 13 as described.

The main body 13 can now be removed from the gun, and remounted in another position. A critical feature of the present invention is that the features on both ends of the main body 13 are identical allowing both the light end cap 35 and negative end cap 45 to be attached to either end of the body 13 thus allowing right hand and left hand assembly and operation.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. For example, although now shown, rather than using a battery for power as illustrated and described, the power source may be some other known power means such as a supply of regulated air pressure from an external source. Thus the scope of the invention should be determined by the appended claims in the formal application and their legal equivalents, rather than by the examples given.

We claim:

1. A rail mounted weapon light comprising:

a main body configured to interface with a firearm having an accessory rail, an outer housing that defines a rail interface profile formed therein such that the weapon light is suited to interface with a track of the accessory rail, said main body including a first body end configured for releasably attaching a first end of the weapon light, and a second body end configured for releasably attaching a second end of the weapon light, a first recess defined on said first body end and a second recess defined on said second body end, wherein said first end of the weapon light includes a first end shaft having at least one lug member configured to engage a first end detent disposed in said first recess, and wherein said second end of the weapon light includes a second end shaft having at least one lug member configured to engage a second end detent disposed in said second recess.

2. The weapon light of claim 1, wherein said first and second body ends are constructed such that said first end of the weapon can be releasably attached to either said first body end or said second body end, and said second end of the weapon light can be releasably attached to either said first body end or said second body end.

3. The weapon light of claim 1, wherein said first end detent includes a hardened ball and spring configured to releasably engage said at least one lug member on said first end shaft, and wherein said second end detent includes a hardened ball and spring configured to releasably engage said at least one lug member on said second end shaft.

4. The weapon light of claim 3, wherein said main body is offset adjacent a side of the accessory rail such that said main body is disposed out of the user's field of view.

5. The weapon light of claim 1, further including a battery spring configured to make conductive contact with a negative end of a power source and a contact plate disposed on said first end of the weapon light, and wherein said contact plate configured to make an electrical connection with a contact pin disposed on said main body.

6. The weapon light of claim 1, further including a battery spring configured to make conductive contact with a negative end of a power source and a contact plate disposed on said second end of the weapon light, and wherein said contact plate configured to make an electrical connection with a contact pin disposed on said main body.

7. A rail mounted weapon light comprising:

a main body that is configured to interface with a firearm having an accessory rail, said main body including an outer housing extension that defines a rail interface profile formed therein that is shaped and sized such that the weapon light is suited to interface with a track of the accessory rail, said outer housing extension having a first end and a second end and a channel that defines said interface profile and extends from said first end to said second end, a pressure switch disposed opposite said interface profile on said outer housing extension, said main body further including a first body end configured for releasably attaching a first end of the weapon light and a second body end configured for releasably attaching a second end of the weapon light, and wherein both said first and second body ends are in electrical communications with said pressure switch, a defined spacing disposed between said main body and the accessory rail, said main body further defines a hollow section for housing a power supply, a first recess defined in said first body end and a second recess defined in said second body end, said first end of the weapon light includes a first end shaft having at least one lug member disposed adjacent an end of the first end shaft, said at least one lug member of said first end shaft configured to engage a first end detent disposed in said first recess to releasably lock said first end of the weapon light to said first recess of the main body, said second end of the weapon light includes a second end shaft having at least one lug member disposed adjacent an end of the second end shaft, said at least one lug member of said second end shaft configured to engage a second end detent disposed in said second recess to releasably lock said second end of the weapon light to said second recess of the main body, and wherein said first and second body ends are constructed such that said first end of the weapon can be releasably attached to either said first body end or said second body end, and said second end of the weapon light can be releasably attached to either said first body end or said second body end.

8. The weapon light of claim 7, wherein said first end of the weapon light is a light head assembly.

9. The weapon light of claim 8, wherein said light assembly includes an illumination member and a light mount end cap.

10. The weapon light of claim 9, wherein said second end of the weapon light is a negative end cap.

11. The weapon light of claim 7, wherein said first end detent includes a hardened ball and spring configured to releasably engage said at least one lug member on said first end shaft.

12. The weapon light of claim 7, wherein said second end detent includes a hardened ball and spring configured to releasably engage said at least one lug member on said second end shaft.

13. The weapon light of claim 7, wherein said main body is offset adjacent a side of the accessory rail such that said weapon light is disposed out of the user's field of view.

14. A rail mounted weapon light comprising:

a main body configured to interface with a firearm having an accessory rail, an outer housing that defines a rail interface profile configured to interface with a track of the accessory rail, said main body including a first body end configured for releasably attaching a first end of the weapon light, and a second body end configured for releasably attaching a second end of the weapon light, and wherein both first and second body ends are in electrical communications with a pressure switch, said main body further defines a hollow section for housing a power supply, a first recess defined on said first body end and a second recess defined on said second body end, said first end of the weapon light includes a first end shaft having at least one lug member configured to engage a first end detent disposed in said first recess to releasably lock said first end of the weapon light with the first recess of the main body, and said second end of the weapon light includes a second end shaft having at least one lug member configured to engage a second end detent disposed in said second recess to releasably lock said second end of the weapon light with the second recess of the main body.

15. The weapon light of claim 14, wherein said first and second body ends are constructed such that said first end of the weapon can be releasably attached to either said first body end or said second body end, and said second end of the weapon light can be releasably attached to either said first body end or said second body end.

16. The weapon light of claim 15, wherein said first end of the weapon light is a light head assembly.

17. The weapon light of claim 16, wherein said light head assembly includes an illumination member and a light mount end cap.

18. The weapon light of claim 17, wherein said second end of the weapon light is a negative end cap.

19. The weapon light of claim 14, wherein said main body is offset adjacent a side of the accessory rail such that said main body is disposed out of the user's field of view.

* * * * *